United States Patent [19]

Carlson

[11] 4,272,654

[45] Jun. 9, 1981

[54] ACOUSTIC TRANSDUCER OF IMPROVED CONSTRUCTION

[75] Inventor: Elmer V. Carlson, Prospect Heights, Ill.

[73] Assignee: Industrial Research Products, Inc., Elk Grove Village, Ill.

[21] Appl. No.: 1,949

[22] Filed: Jan. 8, 1979

[51] Int. Cl.[3] ..... H04R 11/00; H04R 31/00

[52] U.S. Cl. ..... 179/119 A; 29/594; 179/184

[58] Field of Search ..... 179/119 A, 119 R, 117, 179/114 A, 114 R, 184, 180, 179, 107 R, 138, 145, 115 A, 115 R, 115.5 PC; 29/594, 602 A, 602 R; 219/100, 104, 105

[56] References Cited

U.S. PATENT DOCUMENTS

| | | | |
|---|---|---|---|
| 1,156,898 | 10/1915 | Gravell | 219/105 |
| 1,871,739 | 8/1932 | Ringel | 179/180 |
| 2,163,161 | 6/1939 | Wadsworth | 179/119 A X |
| 2,251,001 | 7/1941 | Quam | 179/119 R X |
| 3,092,694 | 6/1963 | Walczak | 29/594 X |
| 3,432,622 | 3/1969 | Sebesta et al. | 179/115 R |
| 3,491,436 | 1/1970 | Carlson | 29/594 |
| 3,588,383 | 6/1971 | Carlson et al. | 179/119 A |

FOREIGN PATENT DOCUMENTS

| | | | |
|---|---|---|---|
| 571801 | 3/1933 | Fed. Rep. of Germany | 179/115.5 PC |
| 45-40477 | 12/1970 | Japan | 219/104 |
| 521809 | 5/1940 | United Kingdom | 29/594 |

*Primary Examiner*—Thomas W. Brown
*Attorney, Agent, or Firm*—Leo J. Aubel

[57] ABSTRACT

An improved transducer construction of the type having a U-shaped armature mounted to have a vibrating arm extending through the tunnel of a cooperating coil. The arms of the armature are joined by a smooth bend to provide improved shock-resistant characteristics. The coil is initially located and properly positioned relative to the arm extending through the tunnel by means of shims. The transducer includes a case comprising a cup, and a cover for the cup, both being of a magnetic material. The cup and cover are joined together by welding to insure low reluctance flux paths therebetween to retain the magnetic fields developed by the transducer within the casing.

3 Claims, 8 Drawing Figures

ACOUSTIC TRANSDUCER OF IMPROVED CONSTRUCTION

BACKGROUND OF THE INVENTION

The present invention is an improvement over the structure disclosed in U.S. Pat. No. 3,588,383 entitled Miniature Acoustic Transducer of Improved Construction issued to Carlson, et al., on June 28, 1971 and which is assigned to the same assignee as the present invention. The transducer disclosed in U.S. Pat. No. 3,588,383 has enjoyed outstanding commercial success, and the present invention is intended to provide an even better transducer than disclosed therein. As disclosed in said patent, the transducer disclosed therein is particularly adapted for use in a hearing aid wherein small transducers are desirable. Since hearing aids are relatively very small in construction, the hearing aid structure includes certain compromises, one of which is to reduce the amount of shock-absorbing material surrounding the transducer in order to reduce the size of the hearing aid; however, the likelihood of shock damage to the transducer is increased. Ordinarily, hearing aids are mounted on the temple of eye glasses or are mounted behind the lobe of the ear. Such transducers are normally not subject to high shock forces, however, the high precision construction of a transducer may be readily distorted when the transducer is accidentally dropped on a hard surface when the user is inserting the unit into his ear.

Additionally, better containment of the magnetic fields developed on the transducer disclosed in U.S. Pat. No. 3,588,383 has been found desirable.

SUMMARY OF THE INVENTION

The present invention improves the armature assembly as disclosed in U.S. Pat. No. 3,588,383. It has been found that when the armature of the prior art is subjected to shock, the principal damage or strain occurs in the area where the arms of the U-shaped armature join to form the folded portion or yoke of the armature. Further, in the prior art construction, the free arm of the armature is inserted into the preformed coil tunnel and generally located therein; next, the armature is of such a shape that the free arm of the armature is precisionally positioned in the air gap. It has, however, been found that when the transducer is subject to high stress or shock forces, the armature will be weak at the points where the armature has been formed or shaped in a bend.

Also, it has been found that when a person wearing a hearing aid including a telephone pick-up coil and the transducer of the aforesaid patent is using a telephone, there may be an undesirable cross talk between the hearing aid transducer and the telephone pick-up coil. This has apparently been caused because the magnetic fields induced within the transducer extend outwardly from the transducer housing and interfere or interact with the telephone coil field.

DESCRIPTION OF THE DRAWINGS

Further objects of the invention, together with additional features contributing thereto and advantages accruing therefrom, will be apparent from the following description of one embodiment of the invention when read in conjunction with the accompanying drawings, wherein.

DESCRIPTION OF THE INVENTION

Figures 1, 2, 3, 3A, 4, 5, 6, 6A:
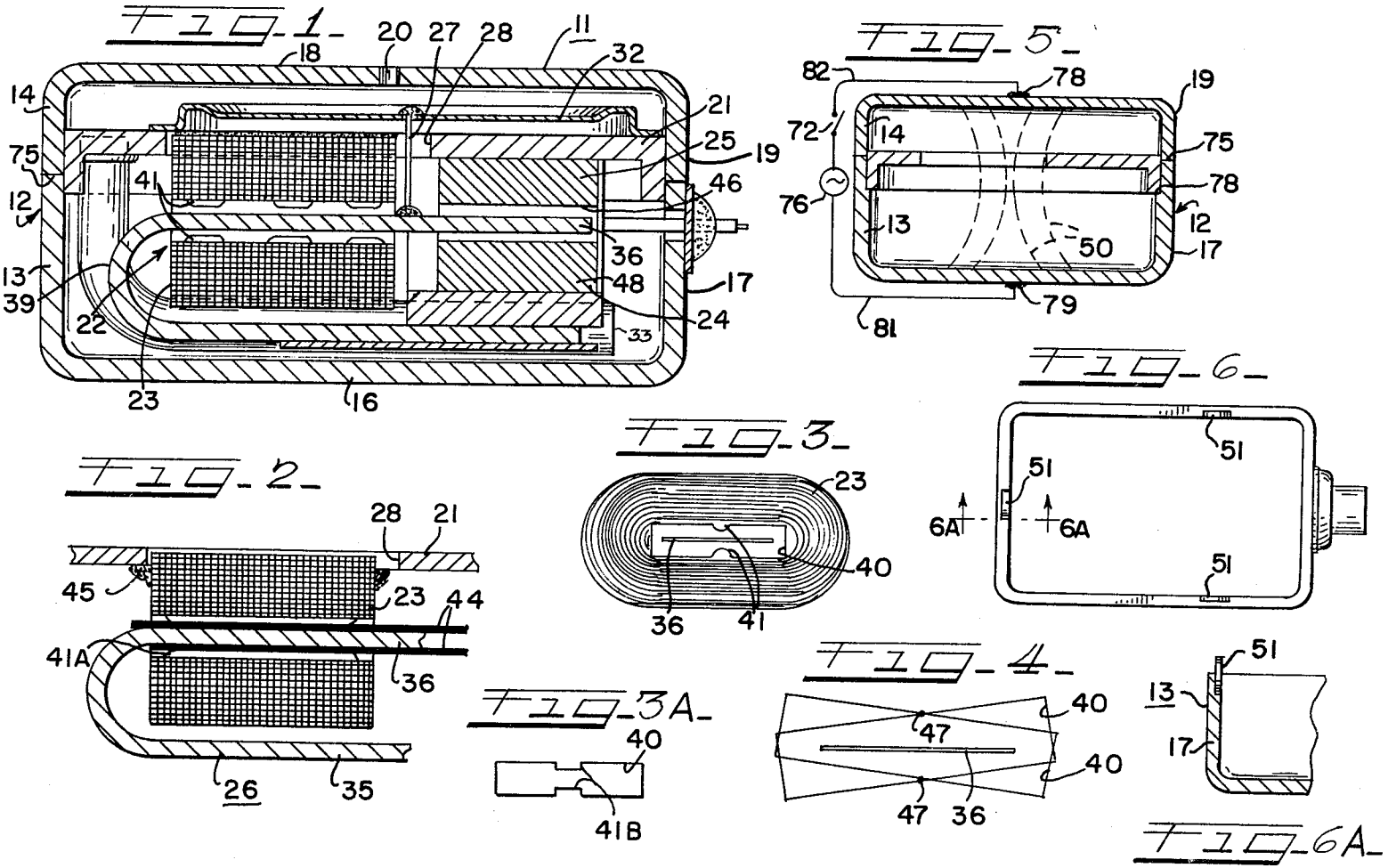
FIG. 1 is a side cross-sectional view of a transducer embodying the invention disclosed herein.
FIG. 2 is a side cross-sectional view showing the method of positioning of the coil around the armature in accordance with the invention.
FIG. 3 is a front view sketch, somewhat exaggerated, of the coil tunnel and is useful in describing the proper positioning of the armature in the coil.
FIG. 3A shows another form of the ridges of FIG. 3.
FIG. 4 is a front view sketch illustrating the positioning of the armature in the tunnel of the coil.
FIG. 5 is a cross-sectional view of the inventive transducer case showing the bulkhead, cup and a cover, indicating roughly in dotted lines the magnetic fields induced in the transducer, and showing in sketch form the structure for welding the cover and cap.
FIG. 6 is a top view of a cup, or lower body portion of the case of FIGS. 1 and 5; and, FIG. 6A is a cross-sectional view taken along the line *6a—6a* of FIG. 6, showing weld projections.

Refer now to the drawings and to FIG. 1 which shows a preferred embodiment of the inventive transducer 11. The transducer includes a case 12 of magnetic material and comprising a cup or body portion 13 and a cover 14. Cup 13 includes a rectangular floor 16 and a continuous substantially perpendicular side wall 17 formed integral with the outer periphery of the floor 16. The cover 14 includes a top 18, substantially identical in outline with the floor 16, and a continuous substantially perpendicular side wall 19 which is formed integral with the outer periphery of the top 18. The edge of the side wall 19 is registrable with the edge of side wall 17. A sound aperture 20 is centrally formed in top 18.

A bulkhead or support plate 21 extends over the open edge of the cup 13 and a motor unit 22 is mounted and secured on bulkhead 21 such as by a suitable adhesive and/or welds. As is known, the motor unit 22 incudes coil 23, permanent magnets 24 and 25, and a generally U-shaped armature 26 connected through a driving pin 27 to a diaphragm 28. The coil 23 is positioned to have one side extend toward a recess or aperture 28 formed in the bulkhead 21 and is securely held in position by conventional adhesive.

The coil 23 may be formed as disclosed in U.S. Pat. No. 3,182,384 entitled Method of Making Self-Supporting Coils and Mandrel Therefor, issued to Elmer V. Carlson on Dec. 27, 1960 and assigned to the same assignee as the present invention. A self-supporting coil is one wherein the windings are retained or held in a desired coil shape such as by an adhesive encapsulant applied during or after winding. As described in the aforesaid U.S. Pat. No. 3,182,384, one coil is wound on a center mandrel of plastic material; and after the coil has been formed, the mandrel is removed by providing a force to opposite ends of the mandrel to, in effect, tear the mandrel apart and pull it out of the tunnel 40 formed in the center of the coil.

Magnets 24 and 25 are mounted, in spaced relation to form a magnetic gap 46 therebetween, on a suitable magnet support 48 which is in turn affixed to the bulkhead 21 also by welding. A conventional Thuras tube 33 may be suitably mounted on bulkhead 21 as is well known in the art.

The generally U-shaped armature 26 has its lower or stationary arm 35 mounted on the magnet support 48. The movable arm or reed 36 of the armature 26 extends through the tunnel 40 formed in the coil 23 and has its other or vibrating end positioned in the magnetic gap of the magnets 24 and 25.

Importantly, the folded portion or yoke 39 of the armature 26 is formed to have a smooth arcuate shape to eliminate any sharp bends in the armature metal. When prior art transducers are subjected to shock forces, mechanical distortion of the armature 26 frequently occurs at the juncture of the yoke 39 with arms 35 or 36. The armature 26 first yields in the region of the outer edge of any bend. Accordingly, the present invention provides an armature 26 which has a smooth or arcuate transition to thereby eliminate bends which produce stress concentrations and weak points in the armature structure.

Further, as discussed above, it is necessary to accurately position the movable reed or arm 36 of the armature 26 in the air gap between the magnets.

Also, it was found that restricting movement of the armature, that is, constraining motion of the armature in the tunnel of the coil to a small clearance about the armature, improved the shock resistance characteristics of the armature.

Accordingly, the present invention provides a means accurately positioning the armature relative to the coil and provides a means of constraining movement of the armature in the tunnel of the coil so that motion of the armature is restricted.

As better shown in FIG. 3, the tunnel 40 of the coil 23 includes oppositely disposed elongated ridges generally designated as 41 extending along the center axis of the tunnel 40. These elongated ridges or protrusions 41 which extend inwardly into the tunnel 40 may be formed such as of coil encapsulant and function to aid in the positioning of the coil 23 in proper location with respect to the armature reed 36 and for restricting movement of the armature reed 36 in the tunnel 40 as will be explained. Note that the ridges 41 may comprise plural discrete ridges as in FIG. 1 or continuous ridges 41A as in FIG. 2. Further, the ridges may be flattened or rectangular ridges 41B as shown in FIG. 3A.

As discussed hereinabove, it is desirable that the coil tunnel 40 be positioned about armature reed 36 in an accurate position and alignment.

Heretofore, it was found necessary to allow sufficient clearance for the armature reed 36 within the coil tunnel 40. In contrast thereto, the present invention provides a structure and method for assembling the armature wherein the coil 23 and tunnel 40 is inserted around the armature reed 36. The U-shaped armature 26 is secured in position such as by welding or brazing. The exact initial location of the armature reed 36 in the tunnel 40 is obtained by positioning locating shims 44 along the sides of the reed 36 in the center of the tunnel adjacent ridges 41. The coil 23 is then movably positioned against the shims 44 and is affixed to the bulkhead 21 as by a suitable adhesive 45 (see FIG. 2). In effect, the coil 23 is placed in proper position about the armature reed 36.

Note that when the coils are wound as described in U.S. Pat. No. 3,182,384 cited above, the turning or winding force applied to the drive end of the mandrel may cause the opposite or free end of the mandrel to be twisted relative to the drive end. Accordingly, the ends of the tunnel 40 which are formed in the coil 23 upon removal of the mandrel may be twisted such as indicated in FIG. 4 (somewhat exaggerated). Accordingly, the thickness of the tunnel 40 must be greater than that required to produce the desired limiting of the reed 36 motion when the transducer receives a mechanical shock. By placing the ridges 41 in FIGS. 1 and 3, ridges 41A in FIG. 2, and ridges 41B in FIG. 3A to extend along or between the central locations 47 depicted in FIG. 4, the reed 36 may be constrained throughout the length of the tunnel 40 without requiring an inordinate degree of precision in forming the tunnel 40.

As described hereinabove, it has been that in certain devices the magnetic fields 50 developed in the transducer 11, when used as a hearing aid, tend to extend outwardly of the case 12 and interfere or interact with the telephone pick-up coil when the hearing aid user is using the telephone. Accordingly, various attempts, including additional shielding external to the case 12, have been made to reduce the effect of the magnetic fields developed by the transducer 11. The present invention provides a means of containing the transducer 11 with the case 12 by welding the cup 13 to the cover 14. It has been found that the welding of the cup 13 to the cover 14 provided a low reluctance flux path for the magnetic fields and tended to retain the flux field within the transducer cover 12. Initially, the transducer 11, cup 13 and cover 14 are abutted. As indicated in FIG. 5, a high power electrode 79 is electrically connected to cup 13 through a suitable lead 81 to a source of potential 76. Source 76 is connected through a switch 77 and lead 82 to a second electrode 78 connected to cover 14. Switch 77 is then selectively closed to provide a high potential across the case 12 which welds together the edges indicated as 75 of the cup 13 and cover 14. The electrodes 78 and 79, the leads 81 and 82, the potential source 76 and the switch 77 constitute what is normally available as a resistance welding machine. The weld at edge 75 need not extend perfectly throughout the edge; it need provide only fusing of the metal at several points to effect low reluctance flux paths.

FIGS. 6 and 6A show a modification of the embodiment of FIGS. 1 and 5 wherein weld projections 51 are selectively formed as at three points along the edge of either cup 13, or cover 14, to facilitate the welding operation and to assure the welding action occurs at these specified points. By utilizing the weld projections, edge contamination and any erratic contacts may be avoided.

It has been found that the welding of the edges reduces the external fields by a significant factor.

Upon a consideration of the foregoing, it will become obvious to those skilled in the art that various modifications may be made without departing from the invention embodied herein. Therefore, only such limitations should be imposed as are indicated by the spirit and scope of the appended claims.

I claim:

1. A transducer comprising in combination a case including a motor positioned therein, said motor comprising an armature, a self-supporting coil having a tunnel formed therein for receiving the armature, a U-shaped armature in said transducer, said armature having a pair of parallel extending arms positioned or joined together by a folded portion, said folded portion of said armature being formed in an arcuate shape, said coil including a tunnel or passageway formed through the center thereof, and ridges extending inwardly into said passageway to limit the movement of said armature to protect said armature against shock damage.

2. A transducer as in claim 1 wherein said ridges extend longitudinally along the center of the tunnel.

3. The method of fabricating a transducer, said transducer including a case and a motor positioned therein, said motor including an armature, a coil including a tunnel or passageway formed therein, a U-shaped armature, said armature having a pair of parallel extending arms positioned to be joined together by a folded portion and one of the armature arms being affixable in place and the other arm being free to vibrate, consisting of the steps of:

(a) forming ridges extending inwardly into said coil passageway;
(b) securing one arm of the armature in place;
(c) positioning shims along the vibratable arm of the armature;
(d) inserting the passageway of the coil around the shims and vibrating arm of the armature; and,
(e) affixing the coil in position in said case.

* * * * *